US007493881B2

(12) United States Patent
Smith et al.

(10) Patent No.: US 7,493,881 B2
(45) Date of Patent: Feb. 24, 2009

(54) DUAL-SIDED AIR INTAKE ASSEMBLY WITH CROSSOVER

(75) Inventors: Stacy L. Smith, Oconomowoc, WI (US); Michael E. Protasiewicz, Waukesha, WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 15 days.

(21) Appl. No.: 11/684,810

(22) Filed: Mar. 12, 2007

(65) Prior Publication Data

US 2008/0223327 A1 Sep. 18, 2008

(51) Int. Cl.
*F02M 35/14* (2006.01)

(52) U.S. Cl. ..... 123/184.21; 123/184.36

(58) Field of Classification Search ..... 123/184.21, 123/184.26, 184.36, 148.44, 184.49, 184.59
See application file for complete search history.

(56) References Cited

U.S. PATENT DOCUMENTS 6,425,363 B1 * 7/2002 Lieske et al. ..... 123/184.21
7,090,552 B2 * 8/2006 Katayama ..... 440/88 A
7,201,129 B2 * 4/2007 Ohba et al. ..... 123/184.21
7,290,519 B2 * 11/2007 Ohba et al. ..... 123/198 E
2004/0093839 A1 * 5/2004 Storz ..... 55/385.3

FOREIGN PATENT DOCUMENTS

JP 2005-90268 * 4/2005

OTHER PUBLICATIONS

Nissan 300ZX V6 engine having a separate airbox and air filter associated with each bank of cylinders, available at least as early as the 1990 model year Nissan 300ZX automobile.

* cited by examiner

*Primary Examiner*—Hai H Huynh
(74) *Attorney, Agent, or Firm*—Michael Best & Friedrich LLP

(57) ABSTRACT

The present invention provides an air intake assembly including a first portion defining a first chamber through which airflow passes. The first portion is coupled to a first throttle member to allow communication from the first chamber to the first throttle member. The air intake assembly also includes a first filter element coupled to the first portion and positioned upstream of the first chamber, and a second portion defining a second chamber through which airflow passes. The second portion is coupled to a second throttle member to allow communication from the second chamber to the second throttle member. The air intake assembly further includes a second filter element coupled to the second portion and positioned upstream of the second chamber, and a conduit coupling the first and second portions. The conduit allows communication between the first and second chambers at a location downstream of the first and second filter elements.

20 Claims, 10 Drawing Sheets

DUAL-SIDED AIR INTAKE ASSEMBLY WITH CROSSOVER

FIELD OF THE INVENTION

The present invention relates to motorcycles, and more particularly to motorcycle air intake assemblies.

BACKGROUND OF THE INVENTION

Motorcycles have been manufactured with several different designs of air intake assemblies or airbox assemblies to feed air to the cylinders of the engines of the motorcycles. Some motorcycles having two or more carburetors or throttle bodies have used a single airbox from which to draw an airflow that has passed through a single air filter. Other vehicles (e.g., automobiles) have used separate and distinct air intake assemblies, each having its own air filter, to provide air to two banks of cylinders in the same engine.

SUMMARY OF THE INVENTION

The present invention provides, in one aspect, an air intake assembly adapted to provide an airflow to a motorcycle engine in a downstream direction, the motorcycle engine having a first throttle member and a second throttle member. The air intake assembly includes a first portion defining a first chamber through which the airflow passes and a second portion defining a second chamber through which the airflow passes. The first portion is adapted to be coupled to the first throttle member to allow fluid communication from the first chamber to the first throttle member and the second portion is adapted to be coupled to the second throttle member to allow fluid communication from the second chamber to the second throttle member. The air intake assembly also includes a first filter element coupled to the first portion and positioned upstream of the first chamber and a second filter element coupled to the second portion and positioned upstream of the second chamber. A conduit couples the first portion and the second portion to allow fluid communication between the first and second chambers at a location downstream of the first and second filter elements.

The present invention provides, in yet another aspect, a method of providing an airflow to a motorcycle engine having a first throttle member and a second throttle member. The method includes providing an air intake assembly having a first chamber and a second chamber, coupling the air intake assembly to the first throttle member to allow fluid communication from the first chamber to the first throttle member, coupling the air intake assembly to the second throttle member to allow fluid communication from the second chamber to the second throttle member, and fluidly communicating the first chamber and the second chamber of the air intake assembly to substantially equalize the pressure of the airflow in the first and second chambers during operation of the motorcycle engine.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
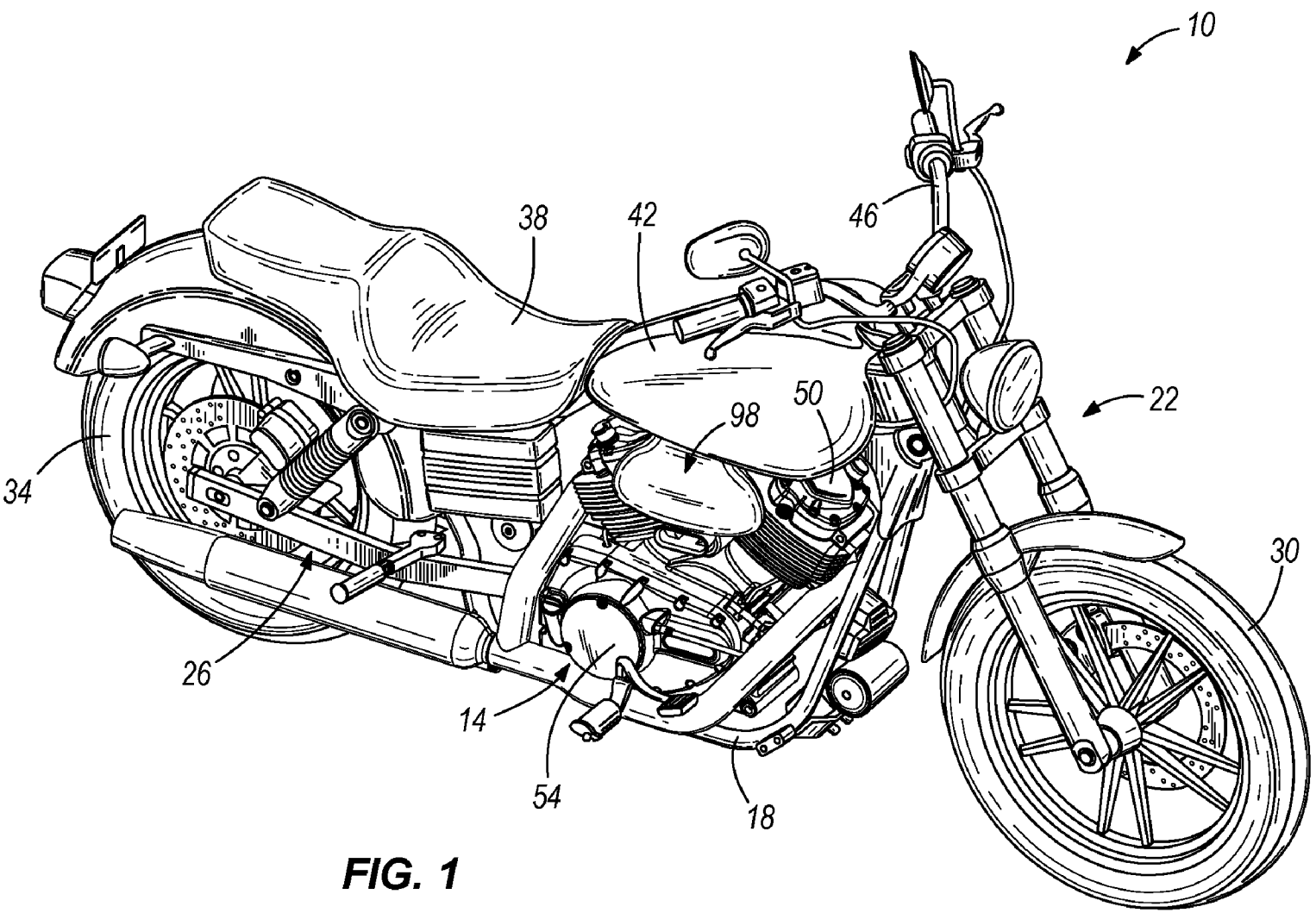
FIG. 1 is a perspective view of a motorcycle including one construction of a dual-sided air intake assembly.

FIG. 1 illustrates a motorcycle 10 including a drive assembly 14, a frame 18, a front fork assembly 22, a swing arm or rear fork assembly 26, a front wheel 30, a rear wheel 34, a seat 38, and a fuel tank 42. The frame 18 supports the drive assembly 14, the front fork assembly 22, the rear fork assembly 26, the seat 38, and the fuel tank 42. The front fork assembly 22 is pivotally supported at a front end of the motorcycle 10 and supports the front wheel 30. The front fork assembly 22 includes a pair of handle bars 46 for steering the motorcycle 10. The rear fork assembly 26 is coupled to the frame 18 at a rear end of the motorcycle 10 and rotatably supports the rear wheel 34. The seat 38 is coupled to the frame 18 and is configured for supporting a rider. The fuel tank 42 is supported by the frame 18 and provides fuel to the drive assembly 14.

The drive assembly 14 is preferably coupled to the frame 18 beneath the seat 38 between the front wheel 30 and the rear wheel 34 of the motorcycle 10. With continued reference to FIG. 1, the drive assembly 14 includes an engine 50 and a transmission 54. The engine 50 is a V-twin engine and includes an output shaft (not shown), such as a crankshaft, which includes a primary drive sprocket (not shown) for driving a primary chain (not shown) in a conventional manner to power the transmission 54.

Figure 2:
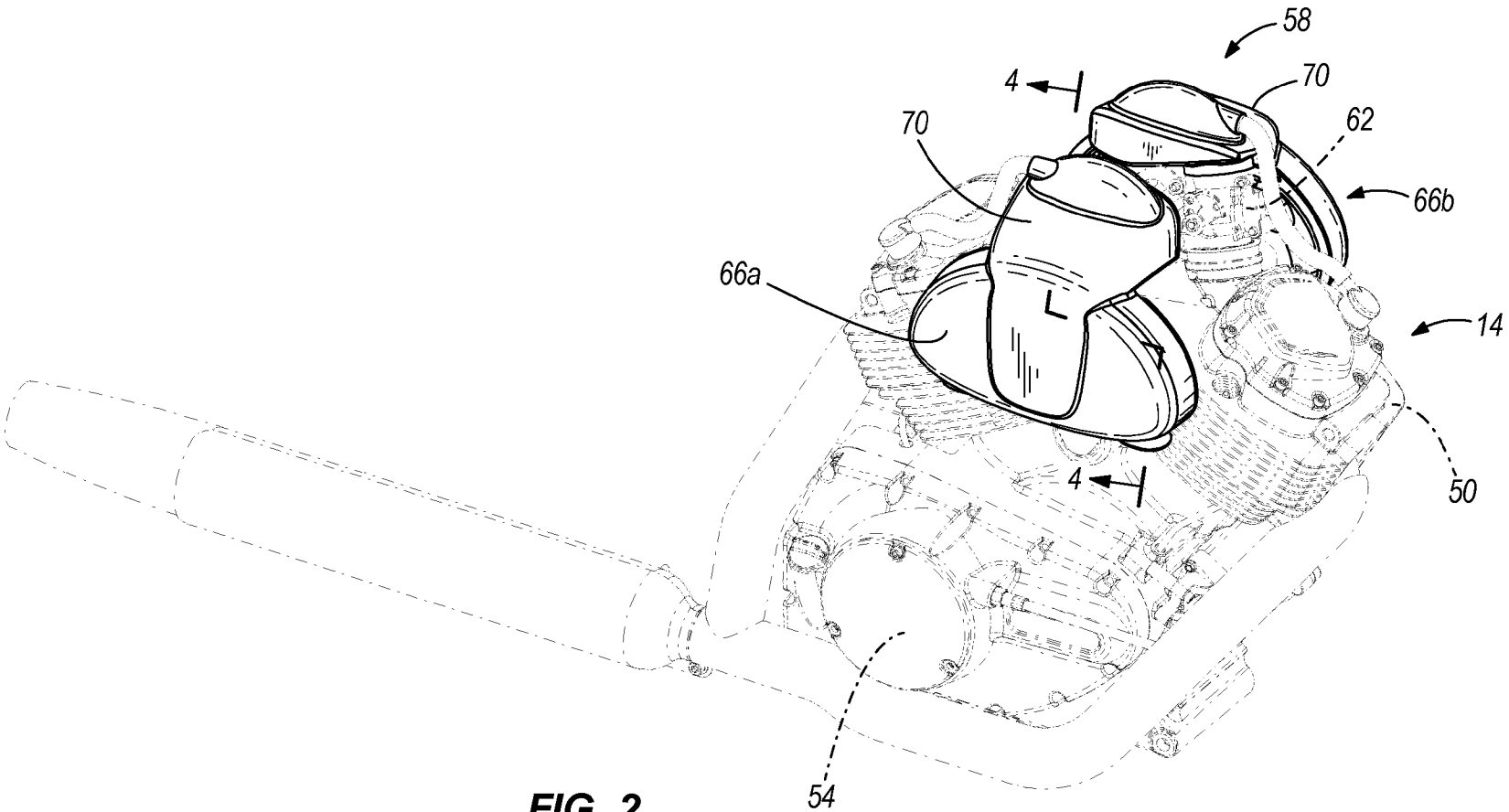
FIG. 2 is an enlarged perspective view of a first construction of the dual-sided air intake assembly.

With reference to FIG. 2, a first construction of a dual-sided air intake assembly 58 is shown coupled to the engine 50. Generally, the air intake assembly 58 is operable to provide a filtered airflow to the engine 50. In the illustrated construction of the engine 50, the dual-sided air intake assembly 58 provides a filtered airflow to dual throttle bodies 62 (only one of which is shown), which meter the amount of filtered airflow that is provided to the cylinders in the engine 50. Accompanying fuel injectors are utilized to add fuel to the filtered airflow. In an alternative configuration of the engine 50, other throttle members may be utilized to meter the amount of airflow to the engine 50. For example, dual carburetors may be provided to both meter the filtered airflow and the amount of fuel that is provided to the engine 50. As such, the air intake assembly 58 may be utilized with engine configurations having throttle members in the form of carburetors or throttle members in the form of throttle bodies 62, or any other suitable air metering device.

Figure 3:
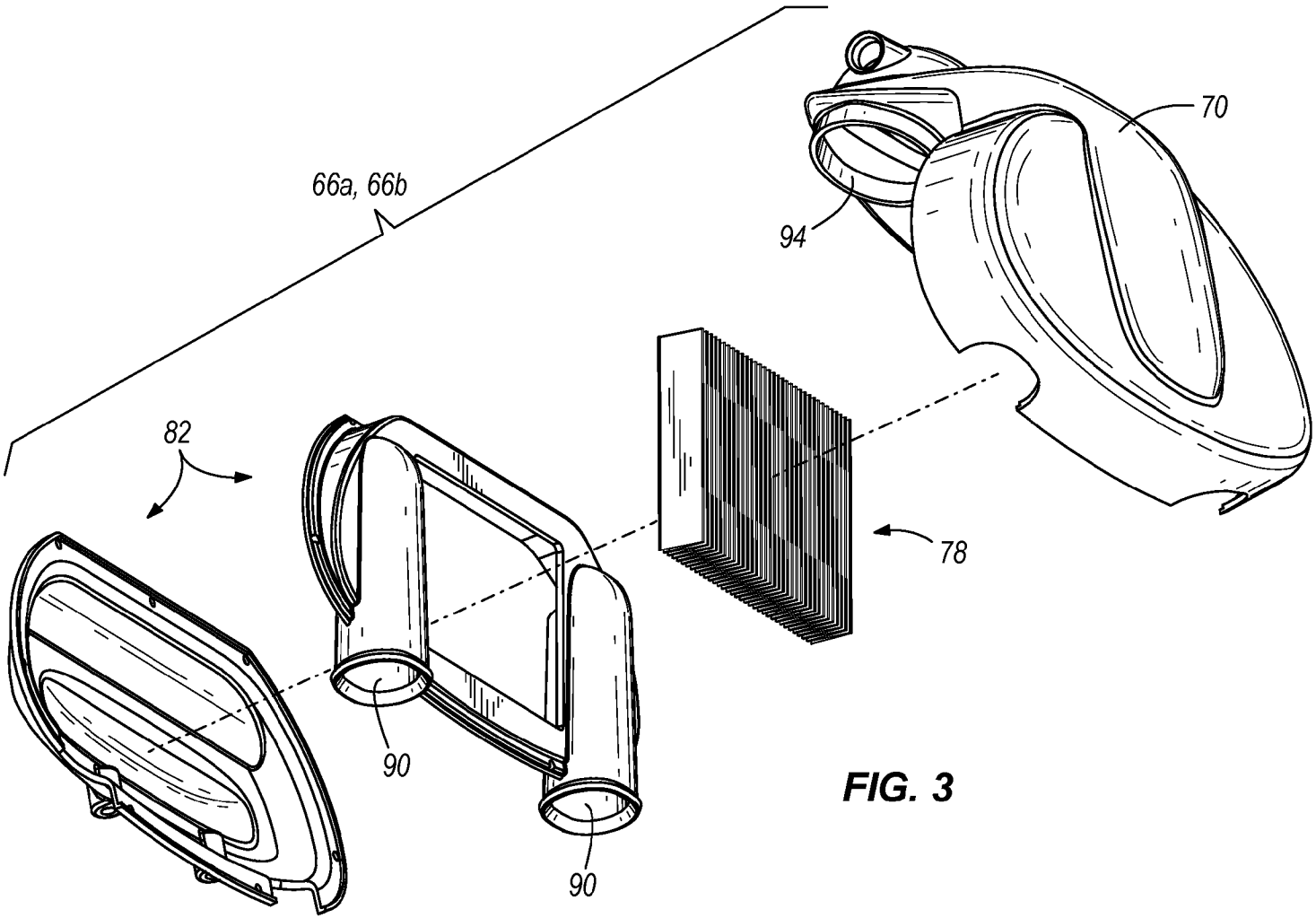
FIG. 3 is an exploded perspective view of half of the dual-sided air intake assembly of FIG. 2.
Figure 4:
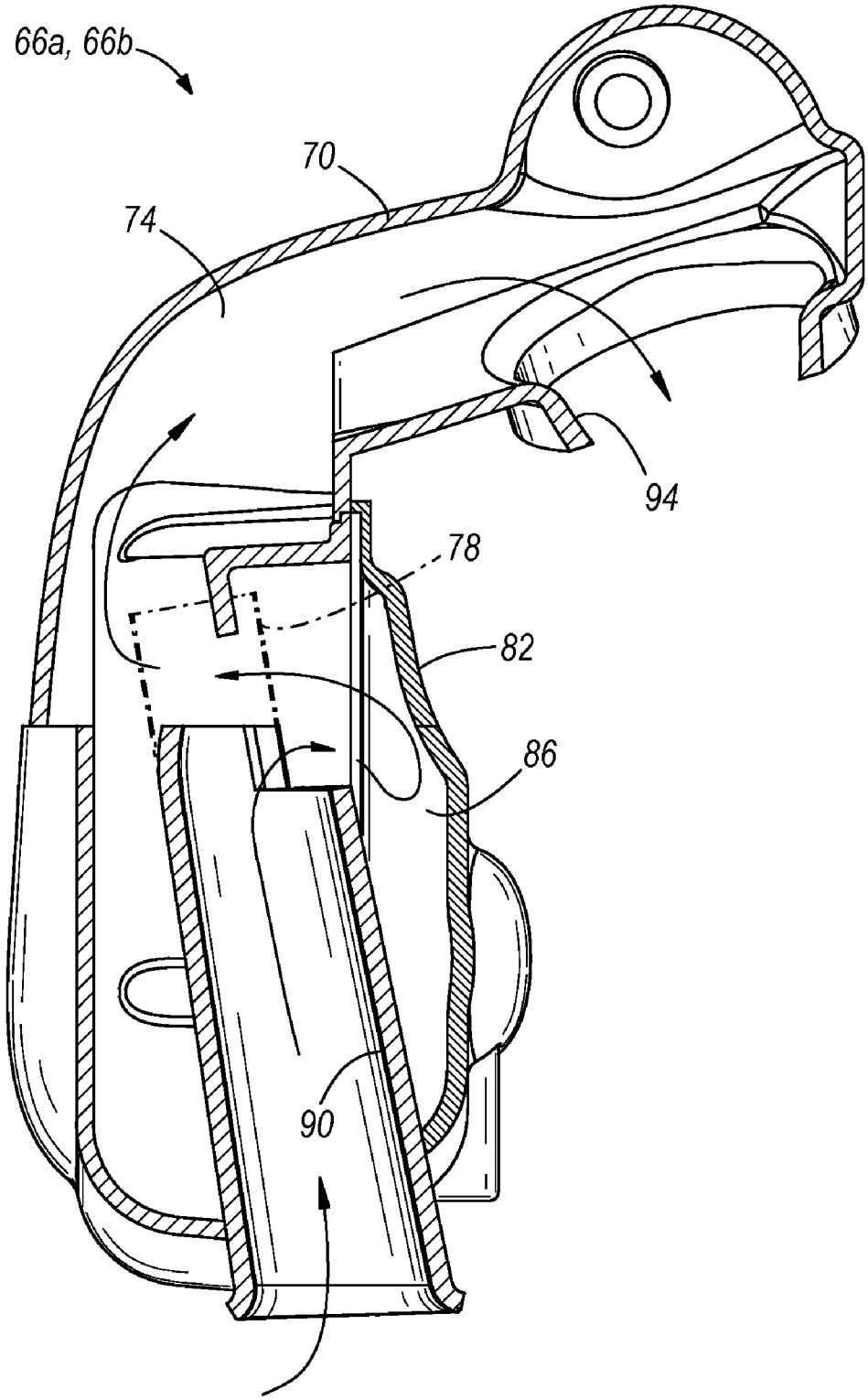
FIG. 4 is a cross-sectional view of the dual-sided intake assembly taken along line 4-4 in FIG. 2.

With continued reference to FIG. 2, the air intake assembly 58 includes dual air cleaners 66*a*, 66*b*, each of which provides a filtered airflow to one of the dual throttle bodies 62 on the engine 50. With reference to FIGS. 3 and 4, each air cleaner 66*a*, 66*b* includes an outlet portion 70 at least partially defining a "downstream" or an outlet chamber 74, an air filter 78 coupled to the outlet portion 70 and positioned upstream of the outlet chamber 74, and an inlet portion 82, at least partially defining an "upstream" or an inlet chamber 86, upstream of the corresponding air filter 78. In the illustrated construction, the air filter 78 is configured as a panel-type air filter 78. Alternatively, the air filter 78 may be configured in any of a number of different ways, so long as the air filter 78 is positioned between the inlet chamber 86 and outlet chamber 74 in each air cleaner 66*a*, 66*b*.

With continued reference to FIG. 4, each air cleaner 66*a*, 66*b* includes at least one inlet passageway 90 in fluid communication with the inlet chamber 86. In the illustrated construction, dual inlet passageways 90 are utilized (see FIG. 3). Alternatively, more or fewer inlet passageways 90 may be utilized in the air intake assembly 58. Further, each air cleaner 66 includes a single outlet passageway 94 in fluid communication with the outlet chamber 74 (see FIG. 4). The outlet passageways 94 are sized to at least partially receive the respective throttle bodies 62 therein.

During operation of the motorcycle 10 with the air intake assembly 58, each cylinder in the engine 50 draws a filtered airflow through only one of the air cleaners 66*a*, 66*b*. In other words, the separate air cleaners 66*a*, 66*b* in the air intake assembly 58 provide separate volumes from which the respective cylinders in the two-cylinder V-twin engine 50 may draw a filtered airflow. Due to the intake cycle of the engine 50 and the reciprocating motion of the piston in each cylinder, a relatively constant vacuum or a negative pressure is developed in each of the separate outlet chambers 74. As a result of the differential between the outside atmospheric pressure and the relatively constant vacuum developed in each of the outlet chambers 74, "dirty" or unfiltered air is drawn through the inlet passageways 90 and into the inlet chamber 86. From the inlet chamber 86, the unfiltered air passes through the air filter 78 and emerges in the outlet chamber 74 as a filtered airflow. The filtered airflow is then drawn through the outlet chamber 74 and through the throttle body 62 via the outlet passageway 94. As previously mentioned, the throttle bodies 62 meter the amount of filtered airflow that is provided to the respective cylinders in the engine 50.

Figure 5:
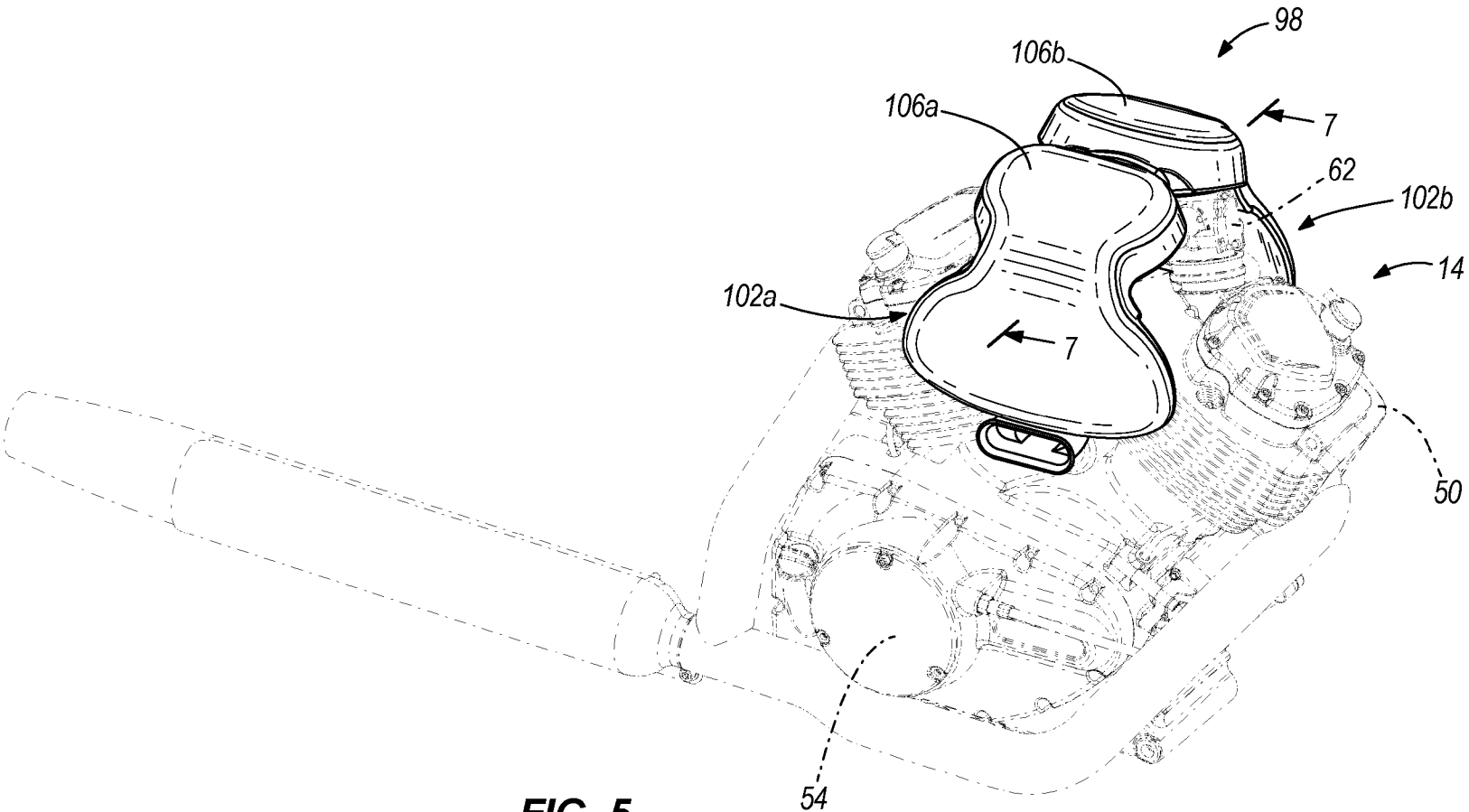
FIG. 5 is an enlarged perspective view of a second construction of the dual-sided air intake assembly.

With reference to FIG. 5, a second construction of a dual-sided air intake assembly 98 is shown coupled to the engine 50. Like the air intake assembly 58 of FIGS. 2-4, the dual-sided air intake assembly 98 provides a filtered airflow to dual throttle members in the form of dual throttle bodies 62 (only one of which is shown), each of which meters the amount of filtered airflow that is provided to the respective cylinders in the engine 50.

Figure 6:
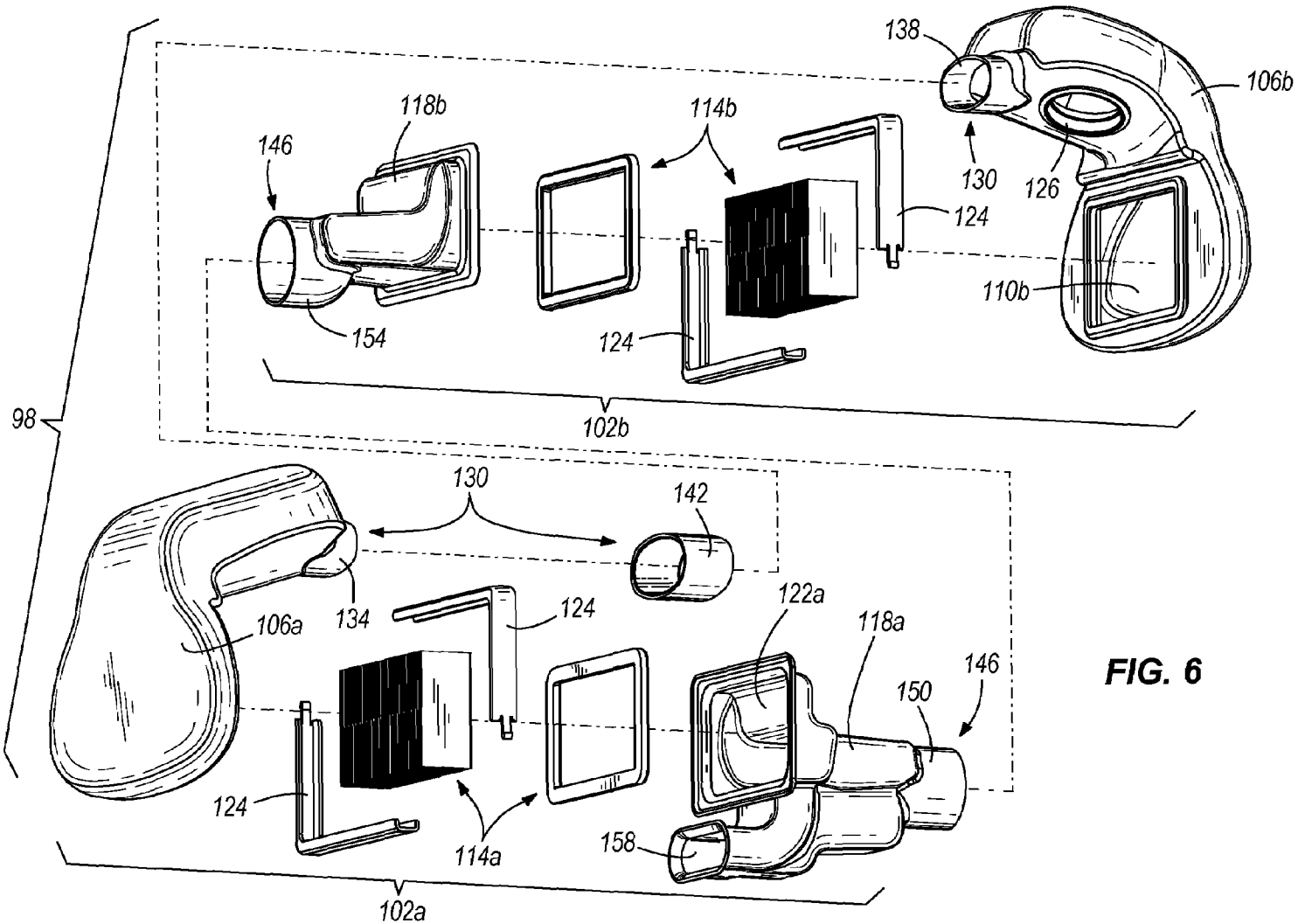
FIG. 6 is an exploded perspective view of the dual-sided air intake assembly of FIG. 5.
Figure 7:
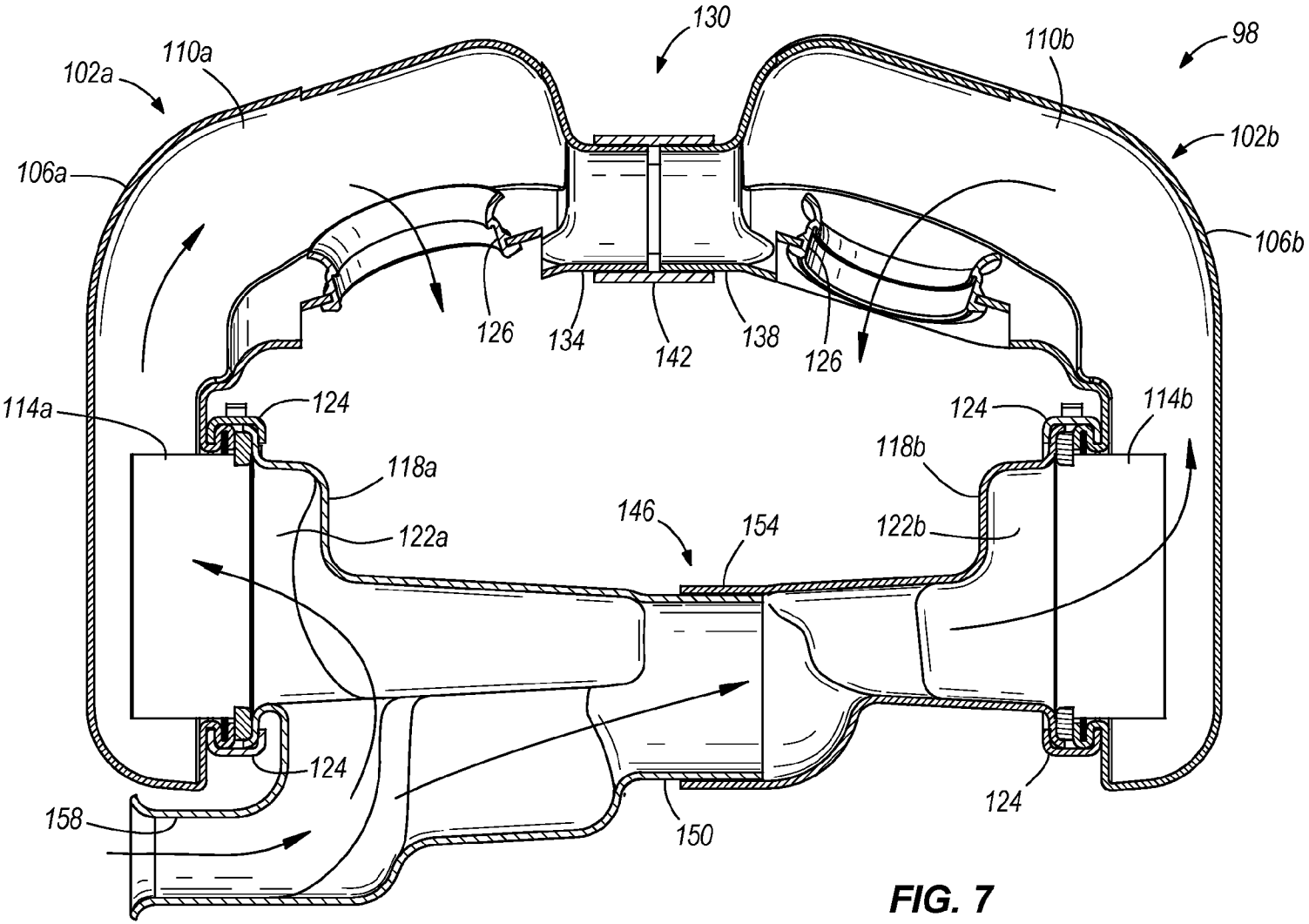
FIG. 7 is a cross-sectional view of the dual-sided air intake assembly taken along line 7-7 in FIG. 5.

With continued reference to FIG. 5, the air intake assembly 98 includes dual air cleaners 102*a*, 102*b*, each of which provides a filtered airflow to one of the dual throttle bodies 62 on the engine 50. With reference to FIGS. 6 and 7, each of the air cleaners 102*a*, 102*b* includes, respectively, an outlet portion 106*a*, 106*b* at least partially defining a "downstream" or an outlet chamber 110*a*, 110*b*, an air filter 114*a*, 114*b* coupled to the outlet portion 106*a*, 106*b* and positioned upstream of the outlet chamber 110*a*, 110*b*, and an inlet portion 118*a*, 118*b*, at least partially defining an "upstream" or an inlet chamber 122*a*, 122*b*, upstream of the corresponding air filter 114*a*, 114*b*. In the illustrated construction, the air filters 114*a*, 114*b* are configured as panel-type air filters 114*a*, 114*b*. As previously stated, the air filters 114*a*, 114*b* may be configured in any of a number of different ways, so long as the air filters 114*a*, 114*b* are positioned, respectively, between the inlet chamber 122*a*, 122*b* and the outlet chambers 110*a*, 110*b*.

With continued reference to FIGS. 6 and 7, each air filter 114*a*, 114*b* is sandwiched between the outlet portions 106*a*, 106*b* and the inlet portions 118*a*, 118*b*, respectively, and interconnecting brackets 124 secure the inlet portions 118*a*, 118*b* to the respective outlet portions 106*a*, 106*b*. Alternatively, the inlet portions 118*a*, 118*b* may be secured to the respective outlet portions 106*a*, 106*b* in any of a number of different ways. With reference to FIG. 6, each air cleaner 102*a*, 102*b* includes a single outlet passageway 126 in fluid communication with the outlet chambers 110*a*, 110*b*. The outlet passageways 126 are sized to at least partially receive the respective throttle bodies 62 therein.

With reference to FIGS. 6 and 7, the air intake assembly 98 includes a conduit 130 that provides fluid communication between the respective outlet chambers 110*a*, 110*b* (see FIG. 7). As shown in FIGS. 6 and 7, the internal volume defined by the conduit 130 is substantially less than the volumes defined by the respective outlet chambers 110*a*, 110*b*, the significance of which is described in greater detail below. Also, in the illustrated construction, at least a portion 134 of the conduit 130 is integrally formed as one piece with the outlet portion 106*a*, and at least a portion 138 of the conduit 130 is integrally formed as one piece with the outlet portion 106*b*.

Further, in the illustrated construction, at least a portion of the conduit 130 is formed by a hose 142 coupling the respective integrally-formed portions 134, 138 of the conduit 130. Although not shown, one or more hose clamps may be utilized to secure the hose 142 to the integrally-formed portions 134, 138 of the conduit 130. In an alternative construction of the air intake assembly 98, the hose 142 may be omitted, and the integrally-formed portions 134, 138 of the conduit 130 may be sized one slightly larger than the other so that the integrally-formed portions 134, 138 may be telescopically engaged with each other. Other suitable ways of forming the conduit 130 are also within the scope of the present invention.

With reference to FIGS. 6 and 7, the air intake assembly 98 includes another conduit 146 coupling the respective inlet portions 118*a*, 118*b*. The conduit 146 provides fluid communication between the respective inlet chambers 122*a*, 122*b* (see FIG. 7). In the illustrated construction, at least a portion 150 of the conduit 146 is integrally formed as one piece with the inlet portion 118*a*, and at least a portion 154 of the conduit 146 is integrally formed as one piece with the inlet portion 118*b*. With reference to FIG. 7, the integrally-formed portions 150, 154 of the conduit 146 are sized one slightly larger than the other so that the integrally-formed portions 150, 154 can be telescopically engaged with each other. In an alternative construction of the air intake assembly 98, the integrally-formed portions 150, 154 of the conduit 146 may be substantially the same size and a hose, similar to the hose 142 coupling the integrally-formed portions 134, 138 of the conduit 130, may be utilized to couple the integrally-formed portions 150, 154. Other suitable ways of forming the conduit 146 are also within the scope of the present invention.

With reference to FIGS. 5-7, a single inlet passageway 158 is utilized to provide unfiltered air to the respective inlet chambers 122*a*, 122*b*. In the illustrated construction, the inlet passageway 158 is integrally formed as one piece with the inlet portion 118*a*, such that the inlet passageway 158 is in direct fluid communication with the inlet chamber 122*a*, and the inlet chamber 122*b* is in fluid communication with the inlet passageway 158 via the conduit 146. Alternatively, the inlet passageway 158 may be integrally formed as one piece with the inlet portion 118*b*, such that the inlet passageway 158 may be in direct fluid communication with the inlet chamber 122*b*, and the inlet chamber 122*a* may be in fluid communication with the inlet passageway 158 via the conduit 146. As a further alternative, separate inlet passageways may be utilized to provide unfiltered air to the respective inlet chambers 122*a*, 122*b*.

During operation of the motorcycle 10 with the air intake assembly 98, each cylinder in the engine 50 draws a filtered airflow mostly from one of the air cleaners 102*a*, 102*b*. In other words, although the respective outlet chambers 110*a*, 110*b* are fluidly communicated with each other by the conduit 130, the throttle body 62 associated with the air cleaner 102*a* mostly draws a filtered airflow from the outlet chamber 110*a*, while the throttle body 62 associated with the air cleaner 102*b* mostly draws a filtered airflow from the outlet chamber 110*b*. As previously described, due to the intake cycle of the engine 50 and the reciprocating motion of the piston in each cylinder, a relatively constant vacuum or a negative pressure is developed in each of the outlet chambers 110*a*, 110*b*. By fluidly communicating the outlet chambers 110*a*,110*b* of the air cleaners 102*a*, 102*b* with the conduit 130, the negative pressure or vacuum in the outlet chambers 110*a*, 110*b* is allowed to equalize, such that the amount of vacuum developed in one outlet chamber 110*a* is substantially equal to the amount of vacuum developed in the other outlet chamber 110*b*.

For this reason, and because of the difference in internal volumes of the outlet chambers 110*a*, 110*b* and the conduit 130, the filtered airflow provided by the air filter 114*a* will be mostly consumed by the cylinder corresponding with the outlet chamber 110*a* and the throttle body 62 associated with the air cleaner 102*a*. Likewise, the filtered airflow provided by the air filter 114*b* will be mostly consumed by the cylinder corresponding with the outlet chamber 110*b* and the throttle body 62 associated with the air cleaner 102*b*. Very little of the filtered airflow in the outlet chamber 110*a* is likely to pass through the conduit 130 for consumption by the cylinder corresponding with the outlet chamber 110*b*. Likewise, very little of the filtered airflow in the outlet chamber 110*b* is likely to pass through the conduit 130 for consumption by the cylinder corresponding with the outlet chamber 110*a*. However, such "volume sharing" is allowed when necessary.

As a result of the differential between the outside atmospheric pressure and the relatively constant vacuum developed in the outlet chambers 110*a*, 110*b*, "dirty" or unfiltered air is drawn through the single inlet passageway 158. Because the negative pressure or vacuum in the outlet chambers 110*a*, 110*b* of the air cleaners 102*a*, 102*b* is substantially equal, the unfiltered air is just as likely to pass through the inlet chamber 122*a* and the air filter 114*a* as it is to pass through the inlet chamber 122*b* and the air filter 114*b*. If the unfiltered air takes the path through the air filter 114*a*, the unfiltered air emerges in the outlet chamber 110*a* as a filtered airflow. Likewise, if the unfiltered air takes the path through the air filter 114*b*, the unfiltered air emerges in the outlet chamber 110*b* as a filtered airflow. The filtered airflow is then drawn through the respective outlet chambers 110*a*, 110*b* and through the throttle bodies 62 via the outlet passageways 126 of the respective outlet portions 106*a*, 106*b*.

By providing the conduit 130 and equalizing the vacuum in the outlet chambers 110*a*, 110*b*, the cylinders in the engine 50 are more likely to receive a consistent amount of filtered airflow for each combustion event during operation of the engine 50. By omitting the conduit 130 (such as in the design of the air intake assembly 58 of FIGS. 2-4), the cylinders in the engine 50 are less likely to receive a consistent amount of filtered airflow for each combustion event because the negative pressure or vacuum developed in one outlet chamber 110*a* might deviate from the negative pressure or vacuum developed in the other outlet chamber 110*b*, thereby affecting the amount of filtered airflow that may be drawn into the respective cylinders in the engine 50.

Also, by providing the conduit 130, pressure waves (generated by individual combustion events during operation of the engine 50) traveling through the respective outlet chambers 110*a*, 110*b* are allowed to interact, which may affect the performance and noise characteristics of the engine 50. Such performance and noise characteristics of the engine 50 may be tuned by varying the size (e.g., cross-sectional area, length, or any combination thereof) of the conduit 130.

Figure 8:
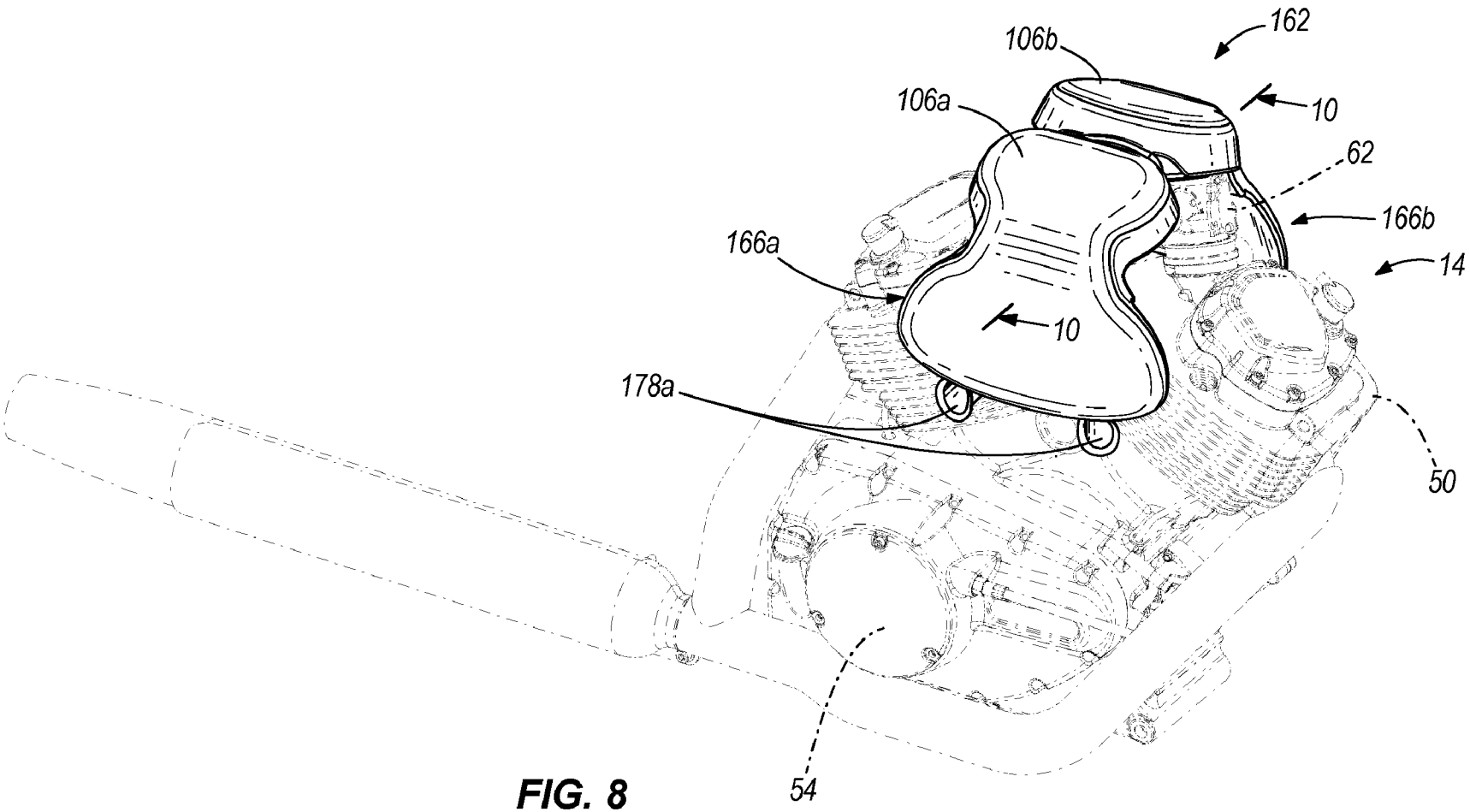
FIG. 8 is an enlarged perspective view of a third construction of the dual-sided air intake assembly.

With reference to FIG. 8, a third construction of a dual-sided air intake assembly 162 is shown coupled to the engine 50. Like the air intake assemblies 58, 98 of FIGS. 2-7, the dual-sided air intake assembly 162 provides a filtered airflow to dual throttle members in the form of dual throttle bodies 62 (only one of which is shown), each of which meters the amount of filtered airflow that is provided to the respective cylinders in the engine 50. As previously stated, throttle members in the form of carburetors may be utilized in place of the throttle bodies 62 in non-fuel injected engines.

Figure 9:
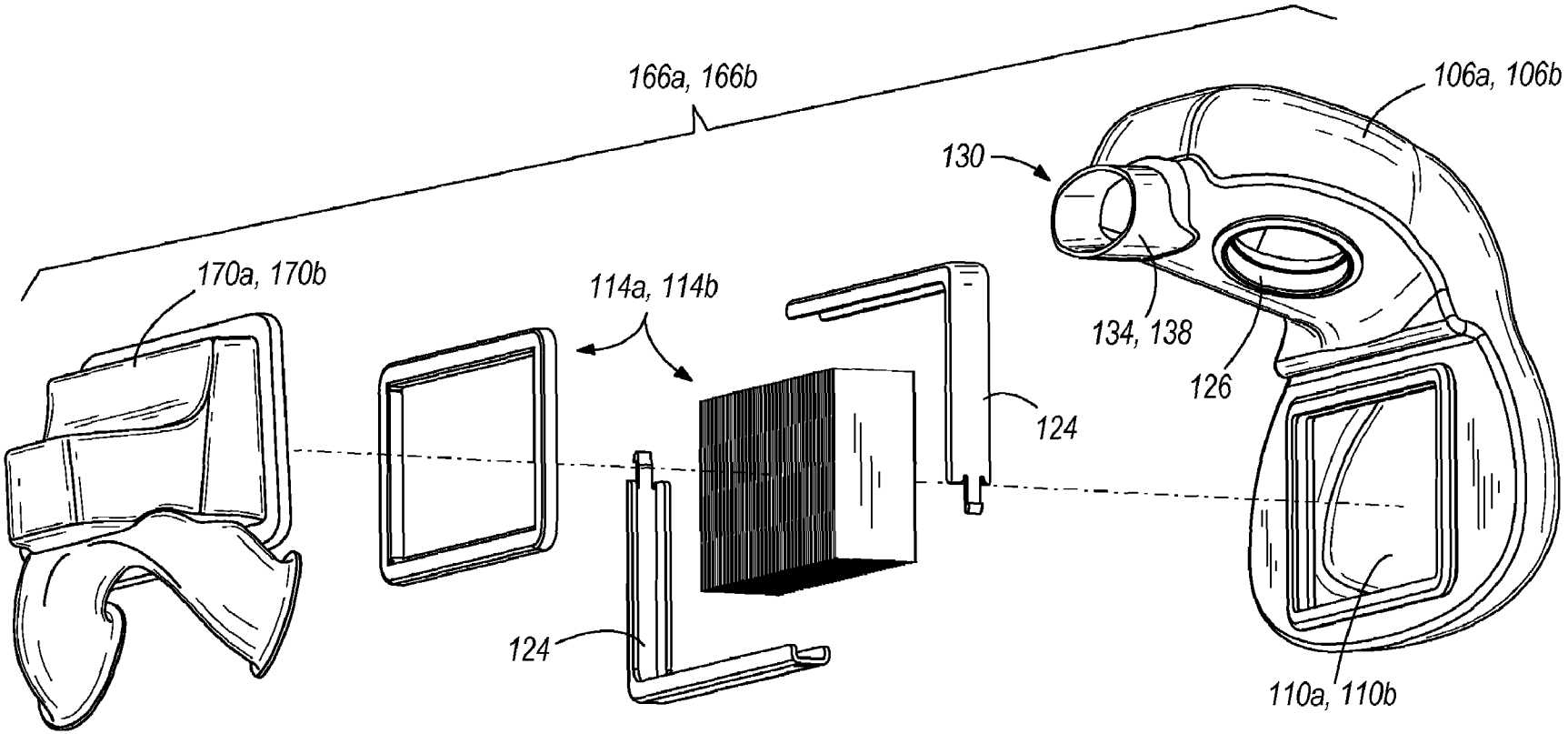
FIG. 9 is an exploded perspective view of a portion of the dual-sided air intake assembly of FIG. 8.
Figure 10:
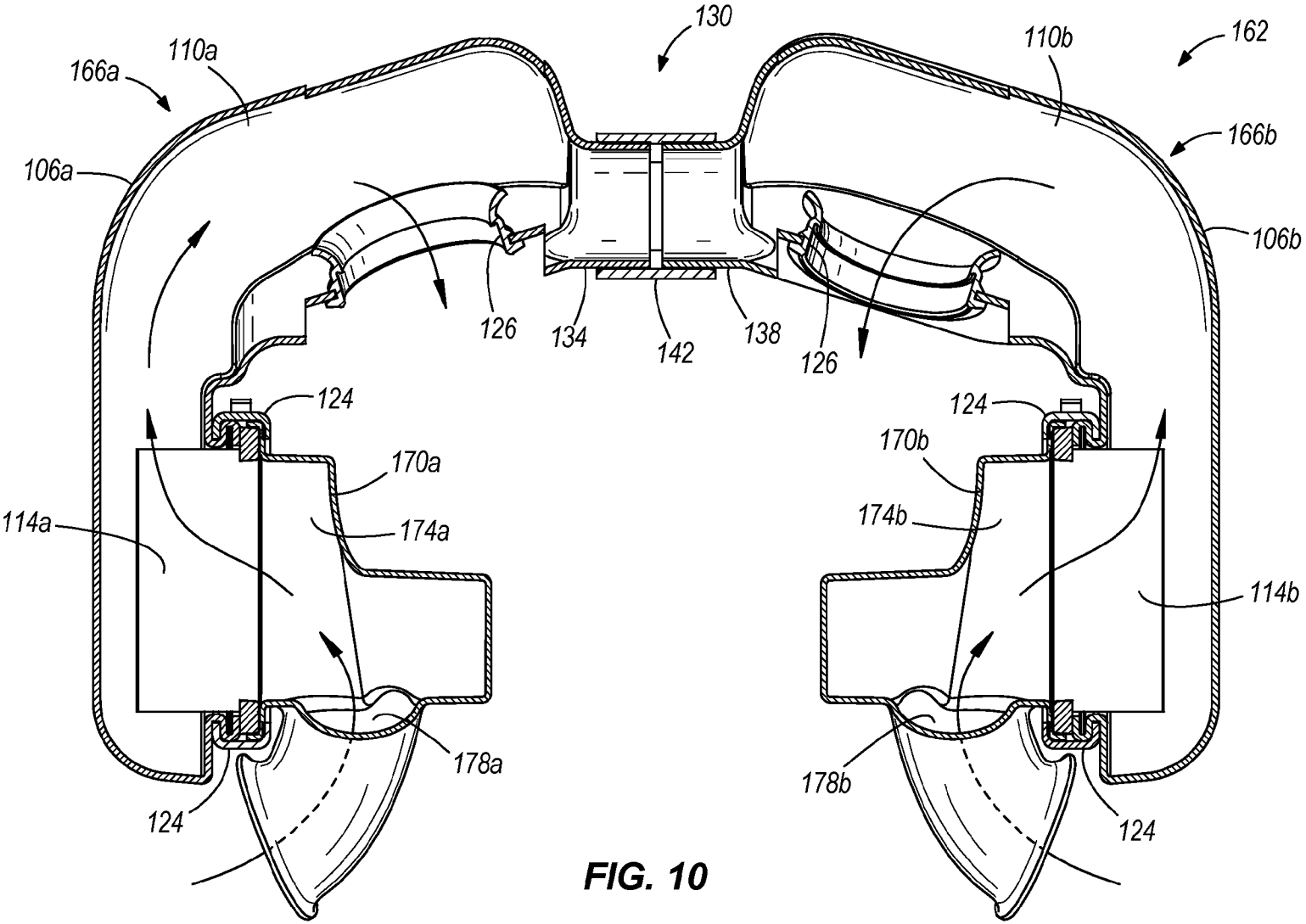
FIG. 10 is a cross-sectional view of the dual-sided air intake assembly taken along line 10-10 in FIG. 8.

With reference to FIGS. 9 and 10, the air intake assembly 162 includes substantially identical dual air cleaners 166*a*, 166*b*, each of which provides a filtered airflow to one of the dual throttle bodies 62 on the engine 50. The air cleaners 166*a*, 166*b* include respective outlet portions and air filters that are substantially similar to the outlet portions 106*a*, 106*b* and air filters 114*a*, 114*b* of the air intake assembly 98 of FIGS. 5-7. As such, like components are labeled with like reference numerals, and will not be described again in detail. The air cleaners 166*a*, 166*b*, however, include respective inlet portions 170*a*, 170*b* that are different from the inlet portions 118*a*, 118*b* of the air intake assembly 98 of FIGS. 5-7. As shown in FIG. 10, the inlet portions 170*a*, 170*b* are separate from one another, and the inlet portions 170*a*, 170*b* are coupled to the respective air filters 114*a*, 114*b* and at least partially define respective "upstream" or inlet chambers 174*a*, 174*b*. The inlet chambers 174*a*, 174*b* are positioned, accordingly, upstream of the respective air filters 114*a*, 114*b* in the air cleaners 166*a*, 166*b*. In the illustrated construction of the air intake assembly 162, the air filters 114*a*, 114*b* are configured as panel-type air filters 114*a*, 114*b*. As previously stated, the air filters 114*a*, 114*b* may be configured in any of a number of different ways, so long as the air filters 114*a*, 114*b* are positioned, respectively, between the inlet chambers 174*a*, 174*b* and outlet chambers 110*a*, 110*b* in the air cleaners 166*a*, 166*b*.

With reference to FIG. 10, the inlet portions 170*a*, 170*b* of the respective air cleaners 166*a*, 166*b* each include two inlet passageways 178*a*, 178*b* in fluid communication with the inlet chambers 174*a*, 174*b* that are utilized to provide unfiltered air to the inlet chambers 174*a*, 174*b*. Alternatively, the inlet portions 170*a*, 170*b* of the air cleaners 166*a*, 166*b* may include more or fewer than two inlet passageways 178*a*, 178*b* to provide unfiltered air to the inlet chambers 174*a*, 174*b*. In the illustrated construction, the inlet passageways 178*a* are integrally formed as one piece with the inlet portion 170*a*, and the inlet passageways 178*b* are integrally formed as one piece with the inlet portion 170*b*.

Because the outlet portions 106*a*, 106*b* of the air intake assembly 162 are substantially similar to the outlet portions 106*a*, 106*b* of the air intake assembly 98 of FIGS. 5-7, the operation of the air intake assembly 162 when coupled to the engine 50 is substantially similar to the air intake assembly 98 of FIGS. 5-7. However, because the inlet portions 170*a*, 170*b* are separate and not in fluid communication with each other, unfiltered air is drawn through the inlet passageways 178*a* to fill the inlet chamber 174*a*, while unfiltered air is drawn through the inlet passageways 178*b* to fill the inlet chamber 174*b*.

Various features of the invention are set forth in the following claims.

What is claimed is:

1. An air intake assembly adapted to provide an airflow to a motorcycle engine in a downstream direction, the motorcycle engine having a first throttle member and a second throttle member, the air intake assembly comprising:

a first portion defining therein a first chamber through which the airflow passes, the first portion adapted to be coupled to the first throttle member to allow fluid communication from the first chamber to the first throttle member;

a first filter element coupled to the first portion and positioned upstream of the first chamber;

a second portion defining therein a second chamber through which the airflow passes, the second portion adapted to be coupled to the second throttle member to allow fluid communication from the second chamber to the second throttle member;

a second filter element coupled to the second portion and positioned upstream of the second chamber; and a conduit coupling the first portion and the second portion, the conduit allowing fluid communication between the first and second chambers at a location downstream of the first and second filter elements.

2. The air intake assembly of claim 1, further comprising:

a third portion defining therein a third chamber through which the airflow passes, the third portion coupled to the first portion and the third chamber positioned upstream of the first filter element; and a fourth portion defining therein a fourth chamber through which the airflow passes, the fourth portion coupled to the second portion and the fourth chamber positioned upstream of the second filter element.

3. The air intake assembly of claim 2, wherein the conduit is a first conduit, and wherein the air intake assembly further includes a second conduit coupling the third portion and the fourth portion, the second conduit allowing fluid communication between the third and fourth chambers at a location upstream of the first and second filter elements.

4. The air intake assembly of claim 2, further comprising an inlet passageway coupled to at least one of the third portion and the fourth portion, wherein the inlet passageway allows fluid communication between the at least one of the third chamber and the fourth chamber and the outside of the third and fourth portions.

5. The air intake assembly of claim 2, further comprising:

a first inlet passageway coupled to the third portion, the first inlet passageway allowing fluid communication between the third chamber and the outside of the third portion; and a second inlet passageway coupled to the fourth portion, the second inlet passageway allowing fluid communication between the fourth chamber and the outside of the fourth portion.

6. The air intake assembly of claim 5, further comprising:

a third inlet passageway coupled to the third portion, the third inlet passageway allowing fluid communication between the third chamber and the outside of the third portion; and a fourth inlet passageway coupled to the fourth portion, the fourth inlet passageway allowing fluid communication between the fourth chamber and the outside of the fourth portion.

7. The air intake assembly of claim 1, wherein the first portion and at least a portion of the conduit are integrally formed as one piece, and wherein the second portion and at least a portion of the conduit are integrally formed as one piece.

8. The air intake assembly of claim 1, wherein the first and second filter elements include panel filter elements.

9. A motorcycle comprising:

a front wheel;

a rear wheel;

a frame supported by the front and rear wheels;

an engine supported by the frame, the engine having a first throttle member and a second throttle member;

an air intake assembly for providing an airflow in a downstream direction to the first and second throttle members, the air intake assembly including a first portion defining therein a first chamber through which the airflow passes, the first portion coupled to the first throttle member to allow fluid communication from the first chamber to the first throttle member;

a first filter element coupled to the first portion and positioned upstream of the first chamber;

a second portion defining therein a second chamber through which the airflow passes, the second portion coupled to the second throttle member to allow fluid communication from the second chamber to the second throttle member;

a second filter element coupled to the second portion and positioned upstream of the second chamber; and a conduit coupling the first portion and the second portion, the conduit allowing fluid communication between the first and second chambers at a location downstream of the first and second filter elements.

10. The motorcycle of claim 9, wherein the air intake assembly further includes a third portion defining therein a third chamber through which the airflow passes, the third portion coupled to the first portion and the third chamber positioned upstream of the first filter element; and a fourth portion defining therein a fourth chamber through which the airflow passes, the fourth portion coupled to the second portion and the fourth chamber positioned upstream of the second filter element.

11. The motorcycle of claim 10, wherein the conduit is a first conduit, and wherein the air intake assembly further includes a second conduit coupling the third portion and the fourth portion, the second conduit allowing fluid communication between the third and fourth chambers at a location upstream of the first and second filter elements.

12. The motorcycle of claim 10, wherein the air intake assembly further includes an inlet passageway coupled to at least one of the third portion and the fourth portion, wherein the inlet passageway allows fluid communication between the at least one of the third chamber and the fourth chamber and the outside of the third and fourth portions.

13. The motorcycle of claim 10, wherein the air intake assembly further includes a first inlet passageway coupled to the third portion, the first inlet passageway allowing fluid communication between the third chamber and the outside of the third portion; and a second inlet passageway coupled to the fourth portion, the second inlet passageway allowing fluid communication between the fourth chamber and the outside of the fourth portion.

14. The motorcycle of claim 13, wherein the air intake assembly further includes a third inlet passageway coupled to the third portion, the third inlet passageway allowing fluid communication between the third chamber and the outside of the third portion; and a fourth inlet passageway coupled to the fourth portion, the fourth inlet passageway allowing fluid communication between the fourth chamber and the outside of the fourth portion.

15. The motorcycle of claim 9, wherein the first portion and at least a portion of the conduit are integrally formed as one piece, and wherein the second portion and at least a portion of the conduit are integrally formed as one piece.

16. The motorcycle of claim 9, wherein the first and second filter elements include panel filter elements.

17. A method of providing an airflow to a motorcycle engine having a first throttle member and a second throttle member, the method comprising:

providing an air intake assembly having a first chamber and a second chamber;

coupling the air intake assembly to the first throttle member to allow fluid communication from the first chamber to the first throttle member;

coupling the air intake assembly to the second throttle member to allow fluid communication from the second chamber to the second throttle member; and fluidly communicating the first chamber and the second chamber of the air intake assembly to substantially equalize the pressure of the airflow in the first and second chambers during operation of the motorcycle engine.

18. The method of claim 17, further comprising:

positioning a first filter element upstream of the first chamber; and positioning a second filter element upstream of the second chamber.

19. The method of claim 17, further comprising providing a single inlet passageway in the air intake assembly for both the first chamber and the second chamber.

20. The method of claim 17, further comprising:

providing a first inlet passageway in the air intake assembly for the first chamber; and providing a second inlet passageway in the air intake assembly for the second chamber.

* * * * *